United States Patent [19]

Plumadore

[11] Patent Number: 4,515,463

[45] Date of Patent: May 7, 1985

[54] INCLINED TONER FLOW CONTROL SYSTEM FOR DEVELOPING AN ELECTROSTATIC LATENT IMAGE UPON AN ELECTROPHOTOGRAPHIC FILM

[75] Inventor: John D. Plumadore, Westfield, Mass.

[73] Assignee: Photon Chroma, Inc., Westfield, Mass.

[21] Appl. No.: 403,806

[22] Filed: Jul. 30, 1982

[51] Int. Cl.[3] ..... G03G 15/10

[52] U.S. Cl. ..... 355/10; 355/27; 118/647; 118/659

[58] Field of Search ..... 355/10, 27, 300; 118/647–651, 662, 659–661

[56] References Cited

U.S. PATENT DOCUMENTS

| | | | |
|---|---|---|---|
| 3,839,071 | 10/1974 | Borelli | 430/42 Y |
| 4,141,647 | 2/1979 | Lempke et al. | 355/10 |
| 4,383,019 | 5/1983 | Simm | 118/650 X |

FOREIGN PATENT DOCUMENTS

| | | | |
|---|---|---|---|
| 2035586 | 6/1980 | United Kingdom | 355/27 |

*Primary Examiner*—A. T. Grimley
*Assistant Examiner*—J. Pendegrass
*Attorney, Agent, or Firm*—Schwartz & Weinrieb

[57] ABSTRACT

A toner flow control system for liquid toner within camera/processor apparatus includes the disposition of a development electrode portion (30) and the electrophotographic film (14) within planes inclined with respect to a horizontal plane at an angle of between 30° and 60°. The film (14) and electrode (30) define a toner flow channel (32) therebetween which is also therefore inclined with respect to the horizontal plane at the same angle, whereby the flow of the liquid toner (36) through the channel (32) is able to be controlled and uniformly distributed over the electrode (30) and film (14). In addition, gravity discharge (46) of the toner (36) from the channel (32) is able to be accomplished without the need for special sealing devices to confine the toner within the toner cell. The controlled flow of the toner within the channel (32) eliminates the need for substantial negative pressure or vacuum suction systems normally employed in conjunction with vertically oriented toner channels.

13 Claims, 1 Drawing Figure

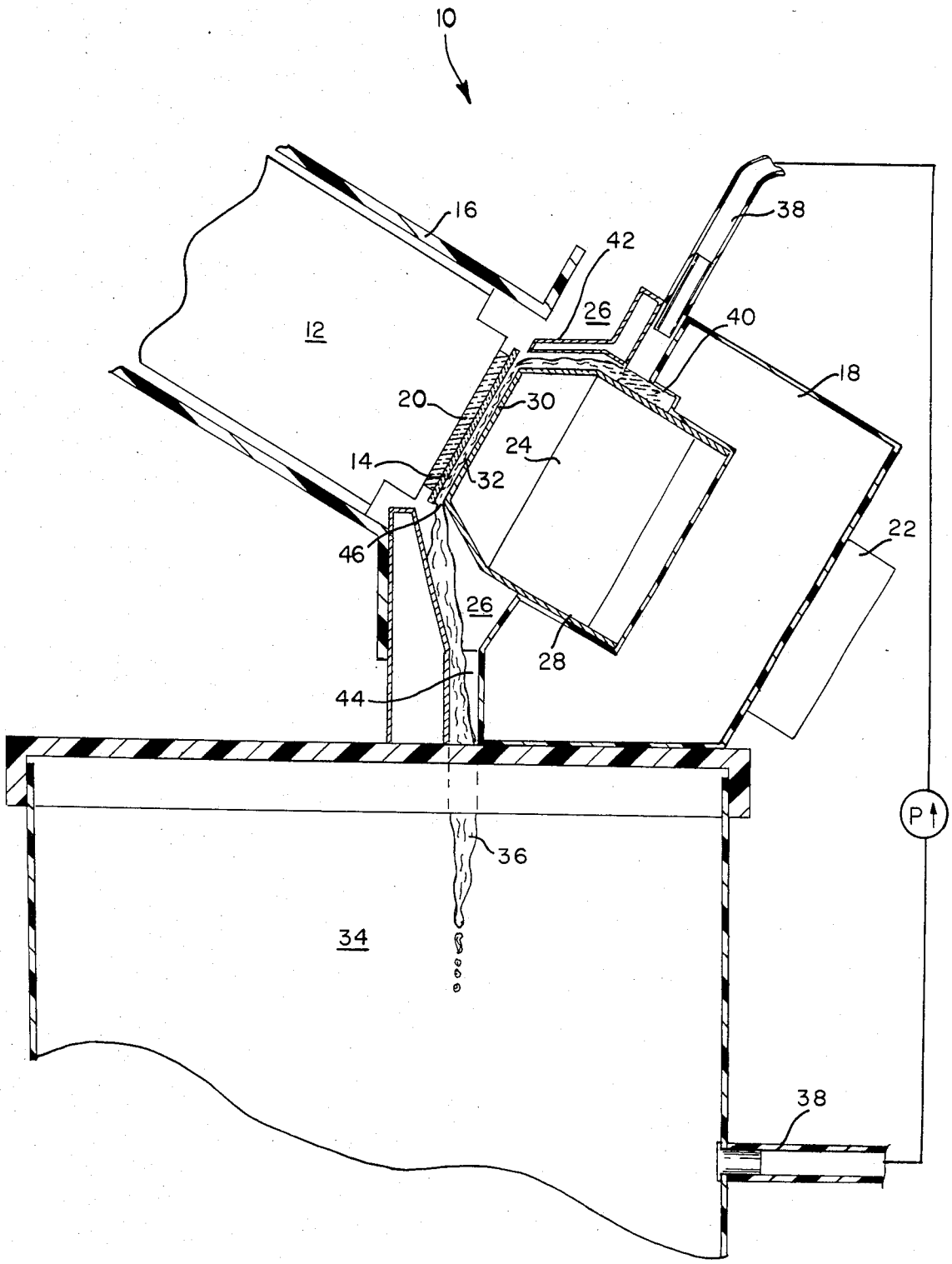
10
16
42
38
26
40
12
18
20
30
24
14
32
22
46
26
28
44
P
36
34
38

INCLINED TONER FLOW CONTROL SYSTEM FOR DEVELOPING AN ELECTROSTATIC LATENT IMAGE UPON AN ELECTROPHOTOGRAPHIC FILM

TECHNICAL FIELD

The present invention relates generally to electrophotography, and more particularly to an improved system of applying liquid developer or toner to an electrophotographic element for developing an electrostatic latent image thereon.

BACKGROUND ART

In electrophotography, a uniform electrostatic charge is initially applied to the surface of a photoconductive layer. This charge is then selectively dissipated in accordance with a particular pattern as determined by exposure of the photoconductive layer surface to a light image. The resulting charge pattern therefore defines an electrostatic latent image upon the photoconductive layer. This latent image may then be rendered visible by applying electrostatically charged toner particles to the photoconductive layer, the toner particles adhering to the photoconductive layer surface by means of electrostatic attraction. In turn, the visible image may now be rendered permanent by subjecting the toner particles to a heating process which fuses the particles to the photoconductive layer.

As is well-known, in accordance with the conventionally acceptable developing method utilizing a liquid developer or toner, which comprises a liquid carrier for finely divided electrostatic toner particles, such as, for example, carbon particles, suspended therein, the electrophotographic element or image-exposed film is initially dipped within the liquid toner so as to produce the visible image thereon which of course corresponds to the originally defined latent image. While this development method has of course proven to be quite satisfactory for some types of systems and film, it is simply not feasible or applicable for the specialized type of system in which the imaging and developing are to be automatically accomplished within a single piece of apparatus. A microphotographic copying machine in which data from successive documents is sequentially recorded upon individual frames of a multi-frame microfiche is an exemplary embodiment of the aforenoted specialized type of apparatus.

In addition, in view of the fact that it is desirable to rapidly image and develop each frame prior to, or partially co-extensive with, the processing of the next succeeding frame, the image development process must, of necessity, be one which can be accomplished quickly and conveniently with respect to, for example, a microfiche, strip or roll film, or aperture card, fixed within a suitable holder or support means within the reproduction apparatus. In particular, the developing system must be capable of quickly and accurately applying the correct amount of developer or toner to the imaged area of the electrophotographic film, as well as removing the excess toner from the film without permitting leakage of the toner particles either into the interior portion of the reproduction apparatus, or onto other areas of the film which have already been imaged or have not as yet been imaged. Still further, the development system must be capable of rapidly evaporating or partially drying any portion of the toner carrier liquid remaining upon the film so as to in fact immobilize the toner particles adhering to the film and thereby prevent any smearing of the toned or visible image.

The foregoing characteristics and objectives have been addressed and substantially achieved in a currently commercially available viable record processor apparatus known as the System 200 which is manufactured and distributed by A. B. Dick/Scott of South Hadley, Mass. This system is embodied within U.S. Pat. Nos. 4,141,647 issued to George D. Lempke and Nils L. Hakanson; 4,047,950 issued to Frank C. Gross; 3,972,610 issued to Frank C. Gross; 3,927,639 issued to the present inventor-applicant of this application, John D. Plumadore; and 3,916,828 issued to Frank C. Gross. All of these patents are concerned, in their entirety, or at least in part, with toner flow control systems wherein, for example, the microfiche, film card, or the like, is disposed within a vertical plane angularly located 90° relative to a horizontal plane. In turn, therefore, when the liquid toner or developer is conducted into fluidic contact with the particular portion of the microfiche or the like being toned or developed, the liquid toner will of necessity be flowing in a vertical plane path.

Thus, while the System 200 comprises viable record processor apparatus, it is apparent that the definition of the toner cell, from the viewpoint of the control of the liquid toner flow characteristics, is necessarily quite complex. Due to the flow of the liquid toner across the face of the photographic element being developed within the vertical plane, as noted hereinbefore, the liquid toner will tend to flow down the full extent of the photographic element or film unless substantial negative pressure or vacuum control means are employed for, in effect, sucking the excess toner off of and away from the film surface. In addition, complex sealing means are often also employed for assuring the appropriate definition of the toner cell. Such sealing means usually comprise components which are movable toward, and retractable away from, the film surface. Such means must be accurately operated and actuated so as not to result in the production of smeared images. Still further, due to the uncontrolled flow of the liquid toner within the vertical plane under the influence of gravity, as well as the vacuum-suction or negative air pressure being impressed upon the liquid toner, nonuniform imaging has also been experienced.

In addition to the aforenoted vertically oriented photographic element systems, and the toner flow control means operatively associated therewith, horizontally disposed photographic element development systems have also been proposed, however, these have proven to be as operationally complex as the vertical systems. As will be readily appreciated, within a system wherein the photographic element being developed is disposed within a horizontal plane while the liquid toner is caused to flow thereover for development of the latent image thereon, there is no natural, that is, gravitational, flow of the toner. Again, therefore, in order to properly control the flow of the liquid toner, substantial pressure differentials must in fact be established. In addition, when liquid toner is caused to flow within a horizontal plane, air bubbles tend to become trapped therein thereby deleteriously affecting the developed image from the viewpoint of image uniformity.

A need therefore exists for an improved toner flow control system for use in developing an electrostatic latent image upon an electrophotographic film or element whereby the liquid toner flow characteristics or parameters can be easily controlled and the toner cell definition easily achieved.

Accordingly, it is an object of the present invention to provide a new and improved toner flow control system for liquid toner utilized for developing an electrostatic latent image upon an electrophotographic element.

Another object of the present invention is to provide a new and improved toner flow control system for liquid toner utilized in developing an electrostatic latent image upon an electrophotographic element which overcomes the operational disadvantages and drawbacks characteristic of similar conventional toner flow control systems.

Still another object of the present invention is to provide a new and improved toner flow control system for liquid toner utilized in developing an electrostatic latent image upon an electrophotographic element whereby the flow of the liquid toner relative to the portion of the electrophotographic element being developed can be accurately and simply controlled.

Yet another object of the present invention is to provide a new and improved toner flow control system for liquid toner utilized for developing an electrostatic latent image upon an electrophotographic element wherein the flow of the liquid toner relative to the portion of the electrophotographic element being developed can be operationally controlled without the requirement of vacuum suction means or the establishment of substantial differential pressure zones.

Yet still another object of the present invention is to provide a new and improved toner flow control system for liquid toner utilized for developing an electrostatic latent image upon an electrophotographic element wherein the flow of the liquid toner relative to the portion of the electrophotographic element being developed can be operationally controlled such that uniform imaging upon the electrophotographic element portion being developed is achieved.

Still yet another object of the present invention is to provide a new and improved toner flow control system for liquid toner utilized for developing an electrostatic latent image upon an electrophotographic element wherein the flow of the liquid toner relative to the portion of the electrophotographic element being developed can be operationally controlled in such a manner so as to provide sufficient toner cell definition without the requirement of auxiliary complex element-contacting sealing means.

A further object of the present invention is to provide a new and improved toner flow control system for liquid toner utilized for developing an electrostatic latent image upon an electrophotographic element wherein there is provided means for rapidly evaporating residual or excess toner carrier liquid remaining upon the film element after toning has been achieved.

A still further object of the present invention is to provide a new and improved toner flow control system for liquid toner utilized for developing an electrostatic latent image upon an electrophotographic element wherein the aforenoted means for evaporating the residual toner carrier liquid is also provided for seating the element film upon the pressure plate of the support means or holder of the reproduction apparatus as well as for aiding in the toner cell definition.

A yet further object of the present invention is to provide a new and improved toner flow control system for liquid toner utilized for developing an electrostatic latent image upon an electrophotographic element which is substantially simple in design and in its structural components interrelationships so as to render the manufacturing costs of this toner system within the overall camera/processor apparatus relatively low.

DISCLOSURE OF THE INVENTION

The foregoing and other objectives of the present invention are achieved through the provision of a toner flow control system wherein there is provided a development electrode having a portion thereof which is inclined relative to a vertical plane and a horizontal plane such that the electrode portion is disposed at an angle, relative to the horizontal plane, between 10° and 80°, and preferably between 30° and 60°. A glass backing plate, which is an integral or fixed part of the electrophotographic film cassette, for example, when roll film comprises the electrophotographic element upon which the latent image is produced, is also inclined at the same angle so as to be disposed parallel to the development electrode portion and thereby define therewith a channel within which the film is disposed and through which the liquid toner will flow. In this manner, it is appreciated that the toner flow path will be inclined relative to the horizontal plane at an angle preferably between 30° and 60°. The particular inclined angle can of course be selected so as to optimize the control parameters of the flowing liquid toner.

Toner is provided from a tank or reservoir and is conducted to the film development channel by means of a suitable pump. Due to the angular inclination or disposition of the film element and the toner flow channel defined between the film element and the development electrode, it is appreciated that when the liquid toner flows downwardly over the surface of the film element upon which the latent image has been produced and reaches the lower edge of the film element, gravity will cause the excess toner to be discharged from the film element. A toner shield is provided within the upper region of the film element and in conjunction with the development electrode so as to define the initial portion of the toner flow path.

Positive air pressure, supplied, for example, by means of a low-power fan or blower, completely surrounds the film element within the toner cell. This positive pressure air therefore serves to seat the film against the cassette glass backing or pressure plate as well as to aid in the definition of the side boundaries of the toner cell which are primarily defined by means of the development electrode as a result of the surface tension or capillarity established between the electrode and the toner. During the cyclic termination of the flow of the toner, that is, at the completion of the toning step of the process and prior to the fusing of the image upon the film element, the low pressure air flow also serves to initially dry the visible image upon the film by evaporating the excess toner carrier liquid. The visible image is therefore now in a stable state and ready to be fused at the fusing station of the apparatus.

Thus it may be appreciated that the inclined toner flow control system of the present invention provides the present inventive apparatus with uniquely accurate and well-defined control over the liquid toner flow parameters. The controlled use of the gravity forces within the present inventive system, as opposed to the uncontrolled employment of the gravity forces within the conventionally available prior art system, permits the liquid toner to be conducted or discharged across or over the latent image film surface and the corresponding surface of the development electrode whereby uniform imaging or toning is able to be achieved. In addition, and just as, or even more, importantly, the foregoing results are able to be achieved without the provision of substantial differential pressure means, toner cell definition seal devices, and the like.

BRIEF DESCRIPTION OF THE DRAWINGS

Various other objects, features, and attendant advantages of the present invention will be more fully appreciated as the same becomes better understood from the following detailed description when considered in connection with the accompanying drawing wherein:

The sole FIGURE is a cross-sectional view of the new and improved toner flow control system of the present invention showing the cooperative parts thereof during a toner development portion of the entire image development process which is to be accomplished by the camera/processor apparatus with which the toner flow control apparatus of the present invention is operatively associated.

BEST MODE FOR CARRYING OUT THE INVENTION

Referring now to the drawing, there is shown the new and improved toner flow control system of the present invention as generally designated by the reference character 10. It is to be understood that the toner flow control system 10 of the present invention is to be utilized within camera/processor apparatus for developing an electrostatic latent image upon an electrophotographic element or medium, and in accordance with the particular disclosed embodiment of the drawing, the element or medium may comprise a film roll or film strip housed within a cassette housing 12. The portion of the film roll or strip which is disclosed as having the latent image produced thereon, and which is adapted to be developed, in part, by the apparatus of the present invention, is designated at 14. While the particularly disclosed embodiment of the electrophotographic film element 14 comprises a roll of microfilm, it is to be understood that the toner flow control system of the present invention is readily adaptable and useable with other types of film elements, such as, for example, aperture cards, microfiche, or the like. In each instance, multiple images are to be developed upon the particular film element in well-known arrays, and the toner flow control apparatus of the present invention is to be utilized for the development of any one of the images of such arrays.

A hollow, cylindrical or annular guide member 16 is mounted upon the base support housing 18 of the camera/processor so as to serve as a mounting or insertion/-withdrawal-facilitating means for the film cassette 12, and it is seen that the cassette 12 is provided at its forward end with a pressure or backing plate 20 against which the film element 14 will be disposed or seated. It is to be further understood that the toner flow control system of the present invention is disposed at a toning station to which the particular film frame being developed at such station has been transported from a charging and exposure station, not shown, although the lens operatively associated with the exposure means of the apparatus at the charging and exposure station is shown at 22, as is part of the corona electrode system 24 which is likewise disposed at the charging and exposure station. In a similar manner, it is also to be appreciated that upon completion of the toning process step of the overall image development process, the toned film portion 14 will be advanced to a fusing station, not shown, whereby the developed image will be fused to the photoconductive layer of the film 14. Means, also not shown, and which may be, for example, a low-power fan or blower, is provided for supplying positive pressure air flow to the three charging and exposure, toning, and fusing stations whereby the film element 14 disposed at the toning station will be completely surrounded by such positive air pressure, the important reasons for which will become apparent hereinafter. As the film element 14 is also subjected to such positive air pressure at the charging and exposure station, as well as at the toning and fusing stations, it is seen that the film element 14 is always pressed against or seated upon the glass backing or pressure plate 20. In addition, when the film element comprises a microfiche or aperture card, the positive pressure also facilitates the insertion of the fiche or card into the camera/processor apparatus by causing the fiche or card to be inserted in a "free-floating" mode. This mode also tends to facilitate insertion of the film element without scratching the film surface, as well as to clean the film element with respect to loose dust particles. The positive pressure at the toning station which annularly surrounds the film element 14 and the toner flow control apparatus of the present invention is indicated at 26.

Referring now to the drawing for a description of the toner flow control apparatus of the present invention, there is also of course provided a development electrode 28 supported within housing 18. The development electrode 28 is uniquely provided with a toner-contacting portion 30 which is inclined relative to a horizontal plane through means of an angle of between 10° and 80°, and preferably of the order of between 30° and 60°. It is seen that the front face of the film backing or pressure plate 20 is similarly inclined so as to be disposed parallel to the inclined portion 30 of the development electrode, and the film element 14, pressed or seated upon the backing or pressure plate 20, is similarly disposed. In this manner, a toner flow control channel 32 is thereby defined between the film element 14 and the development electrode portion 30 so as to also have the requisite degree of inclination.

A toner reservoir or tank 34 is disposed beneath the housing 18, and toner 36 is supplied to the toner flow control channel 32 by means of a conduit 38 and suitable pump apparatus P. The upper end of conduit 38 is fluidically connected to a toner supply chamber 40 defined within housing 18, and the latter is provided with a rearwardly projecting shield member 42 which serves to define a flow path for, and conduct, the liquid toner 36 into the upper end of the toner flow control channel 32. The lower end of the channel 32 discharges, under the influence of gravity, into a drain channel 44 operatively defined within the lower portion of housing 18 and fluidically connected to the upper portion of reservoir 34. A recirculatory toner flow system is thus defined by means of toner reservoir 34, conduit 38, toner supply chamber 40, toner flow control channel 32, and drain channel 44.

In operation, as will certainly be appreciated, the toner flow control system of the present invention is substantially different from the conventional toner development systems wherein, for example, the toner channel 32 would be disposed within a vertical plane. By the proper selection of the particular angle of inclination of the plane within which toner flow control channel 32 of the present invention is disposed relative to a horizontal plane, the flow speed of the liquid toner is able to be optimally controlled so as to enhance the uniform imaging upon the photographic element 14. This is in fact achieved due to the controlled flow distribution of the liquid toner over the inclined development electrode portion 30 and the inclined element 14. In addition, air bubbles are permitted to escape from the liquid toner in a controlled fashion.

In addition, the system of the present invention uniquely permits the drainage or separation of the excess liquid toner 36 from the bottom edge of the film element, as at 46, under the influence of gravity operating, of course, within a vertical plane, without any requirement for substantial negative pressure or vacuum suction means as is characteristic of the vertically oriented toner flow channels. Similarly, special sealing means, including those of the auxiliary retractable type, for engaging the film element so as to thereby define the toner cell, are also rendered unnecessary. Toner cell definition within the system of the present invention is well defined by means of the upper toner flow control shield 42, and the gravity discharge assistance at 46. The lateral boundaries of the toner cell are primarily defined by means of the lateral extent or dimension of the inclined portion 30 of the development electrode 28, and these lateral boundaries are also aided in their definition by means of the aforenoted annular areas of positive air pressure 26 as well as the provision of such positive air pressure within the exposure and charging station, not shown, disposed toward one side of the toning station, and within the fusing station, also not shown, which is disposed toward the other side of the toning station. Still further, such toner cell definition may be additionally insured by the provision of insulation strips or other similar means within the vicinity of the lateral side edges of the development electrode. By such means, a negative meniscus is impressed upon the liquid toner, which together with the surface tension or capillarity already established between the liquid toner and the development electrode, tends to maintain the toner cell well-defined in its lateral extent.

After the toning step of the development process is completed, flow of the liquid toner is terminated, and in view of the fact that the entire region annularly surrounding the film element is still continuously subjected to the positive air pressure as at 26, to which region the toner flow control channel 32 is now fluidically connected in view of the absence of toner within channel 32, the air flow within channel 32 serves to initially dry the developed image upon the film element 14 so as to render the image stable. Subsequently, the film element or frame may be transported to the fusing station wherein the developed image may be permanently fused to the photoconductive layer of the element 14.

Obviously, many modifications and variations of the present invention are possible in light of the above teachings. For example, while the specific embodiment of the present invention has been disclosed in connection with a roll film element 14 of a cassette 12, the underlying principles of the present invention are equally applicable to other film element media, such as, for example, an aperture card, microfiche, or the like. In utilizing the system of the present invention in conjunction with a microfiche or aperture card, an air knife or other similar means may be utilized within the vicinity of gravity discharge point 46 so as to assist the separation of the liquid toner at such point so as not to experience the continued flow of the liquid toner to a lower portion of the fiche, for example, when an upper frame in the grid array thereof is being imaged and developed. It is therefore to be understood that within the scope of the appended claims, the present invention may be practiced otherwise than as specifically described herein.

I claim:

1. Toner flow control apparatus for developing individual electrophotographic latent images upon an electrophotographic film, comprising:

a development electrode;

an electrophotographic film having an upper edge portion, a lower free edge portion, and a predetermined longitudinal extent with said electrostatic latent images disposed thereon in a serial arrangement along said predetermined extent, and disposed adjacent to said development electrode such that said electrostatic latent images face said development electrode;

said electrophotographic film and said development electrode defining a channel therebetween; and means for introducing toner into said channel in a direction transverse to said longitudinal extent of said electrophotographic film whereby said toner flows across said electrophotographic film from within the vicinity of said upper edge portion of said electrophotographic film to said lower free edge portion of said electrophotographic film for development of said individual electrostatic latent images, said development electrode, said electrophotographic film, and said toner channel being disposed within parallel planes inclined with respect to a horizontal plane such that said toner flows through said channel and over the facing surfaces of said electrophotographic film and said development electrode in a controlled manner along said transverse direction across said electrophotographic film from within the vicinity of said upper edge portion of said electrophotographic film to said lower free edge portion of said electrophotographic film so as to be discharged from said channel and said lower free edge portion of said electrophotographic film within a vertical plane under the influence of gravity.

2. Apparatus as set forth in claim 1, further comprising:

toner cell means for housing said toner for development of said electrostatic latent image defined, in part by means of said development electrode, said toner introducing means, and the intersection of said film means and said vertical discharge plane.

3. Apparatus as set forth in claim 1, wherein:

said film comprises a roll of film.

4. Apparatus as set forth in claim 1, wherein:

said means for introducing said toner into said channel comprises a recirculatory pumping system.

5. Apparatus as set forth in claim 1, further comprising:

backing plate means for seating said film during said development of said electrostatic latent image.

6. Apparatus as set forth in claim 5, further comprising:

means for supplying positive air pressure to an area annularly surrounding said film for pressing said film against said backing plate means.

7. Apparatus as set forth in claim 6, wherein:

said annularly surrounding area is fluidically connected to said channel so as to dry said toner upon completion of said development of said electrostatic latent image.

8. Apparatus as set forth in claim 1, further comprising:

means for supplying positive air pressure to an area annularly surrounding said film for aiding in the confinement of said toner to said channel.

9. Apparatus as set forth in claim 1, wherein:

said angle of inclination of said electrode, film, and said toner channel is within the range of 30°–60°.

10. Apparatus as set forth in claim 1, wherein:

said electrophotographic film is disposed in a stationary mode relative to said development electrode when said toner is introduced into said channel.

11. Apparatus as set forth in claim 1, further comprising:

a reservoir tank for collecting said toner discharged from said lower free edge portion of said electrophotographic film.

12. Apparatus as set forth in claim 1, wherein:

said development electrode is disposed below said electrophotographic film within said parallel planes.

13. Apparatus as set forth in claim 12, wherein:

the inclination of said electrophotographic film is such that said toner is discharged from said lower free edge portion of said electrophotographic film and within said vertical plane so as to flow away from the non-imaged surface of said electrophotographic film whereby said discharging toner does not collect upon said non-imaged surface of said electrophotographic film.

* * * * *